United States Patent [19]

Kolben et al.

[11] 3,998,307

[45] Dec. 21, 1976

[54] PARKING METER

[76] Inventors: Felix D. Kolben, Ferstelgasse 4, A-1090 Vienna; Franz Hammer, Schwedgasse 29-35, A-1230 Vienna; George Tauber, Kandlgasse 37, A-1070 Vienna, all of Austria

[22] Filed: Apr. 10, 1975

[21] Appl. No.: 566,769

[30] Foreign Application Priority Data

Nov. 15, 1974 Switzerland ..... 15279/74

[52] U.S. Cl. ..... 194/4 R; 194/DIG. 18; 194/DIG. 22; 116/114 T

[51] Int. Cl.[2] ..... G07F 1/06

[58] Field of Search ..... 194/1 R, 4 R, 4 B, 4 C, 194/4 D, 4 E, 4 F, 4 G, DIG. 18, DIG. 22, DIG. 23; 116/135, 114 T

[56] References Cited

UNITED STATES PATENTS

| | | | |
|---|---|---|---|
| 1,714,157 | 5/1929 | Clark | 194/DIG. 22 |
| 1,752,071 | 3/1930 | Doyle | 116/114 T |
| 3,273,683 | 9/1966 | Goodman | 194/4 R |
| 3,338,364 | 8/1967 | Hoffberger et al. | 194/4 R |

*Primary Examiner*—Robert B. Reeves
*Assistant Examiner*—Joseph J. Rolla
*Attorney, Agent, or Firm*—Wenderoth, Lind & Ponack

[57] ABSTRACT

A parking indicator can be adjusted to assume at least an inoperative position or condition, the presence of which indicates lack of parking permission. Change-over from a condition which does not indicate parking permission, i.e. an operative condition or position, into the inoperative condition and back again, results in the destruction or loss of at least one value symbol. A time indicator is provided in order to indicate the time when parking commences. The time indicator is adjustable only when the parking indicator is in an inoperative condition or while it is being brought into this condition.

20 Claims, 14 Drawing Figures

Fig. 4 c
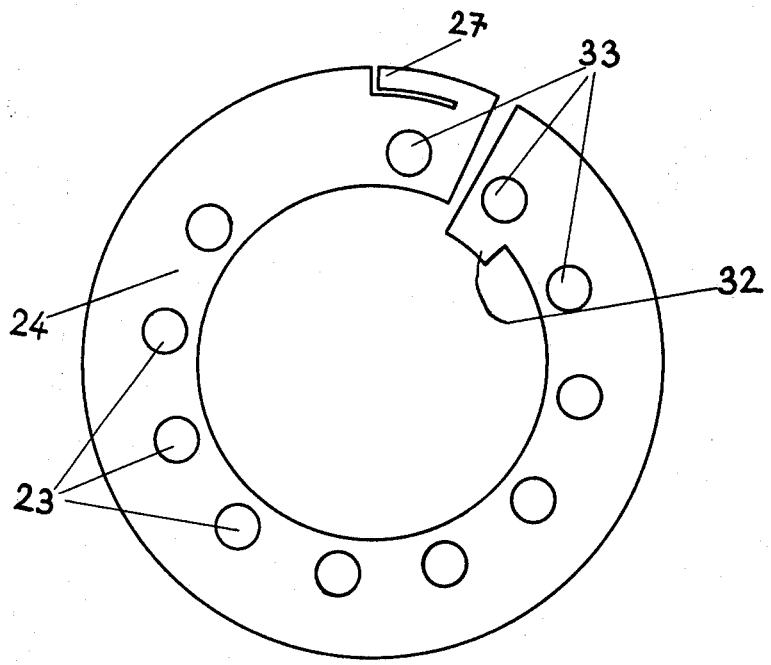
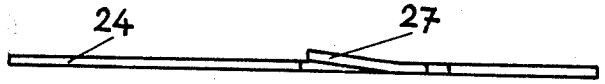
Fig. 4d

PARKING METER

BACKGROUND OF THE INVENTION

The present invention relates to a parking indicator which can be adjusted to assume at least an inoperative position or condition, the presence of which indicates lack of parking permission. The change-over from a condition which does not indicate lack of parking permission, i.e. an operative condition or position, to the inoperative condition and back again into the operative condition results in the destruction or loss of at least one value symbol.

In order to provide an opportunity to charge a fee for the parking of motor vehicles, such fee corresponding to the length of time the vehicle is parked, stationary parking meters have already been established in many cities. These meters are operated by the insertion of coins or other tokens, and include an indicating device which allows monitoring personnel easily to see whether the apparatus is operative or not. Where such parking meters are concerned, a clockwork mechanism is set in motion when the operative condition commences and, when the parking period paid for is ended, the clockwork mechanism switches off the parking meter so that any further occupancy of the relevant site by the motor vehicle may be readily detected.

Such parking meters can scarcely be used in a relatively large area, for example in the entire central area of a large city, for the purpose of levying parking fees. Quite apart from the cost of such an arrangement, the equipping of an entire municipal area with parking meters disposed at short distances from one another would be aesthetically inappropriate. Also the collection of the quantity of coins contained in the parking meters in such a case, and even the securing of such a large number of parking meters against breakage or pilfering would be in many cases practically infeasible.

SUMMARY OF THE INVENTION

The object of the present invention is to provide an apparatus for monitoring the payment of parking fees and which does not have to be rigidly disposed, but is simply constructed so that each motor vehicle can be equipped with such an apparatus. A prerequisite for the provision of such an inexpensive apparatus is that it is not constructed as a parking meter in the more restricted sense. In other words no clockwork mechanism is required for the functioning of the device of the present invention.

This object is achieved in accordance with the present invention in that a time indicator is provided in order that the time when parking commences can be indicated, and in that the time indicator is only adjustable when the parking meter is in an inoperative position or while it is being brought into such position.

Thus, the present invention is based on the assumption that in a parking operation the time of the commencement of parking, which is to be set with the time indicator, is at some different value. This prerequisite is not however sufficient if the time indicator only indicates the time. In such case, a vehicle owner could place his vehicle on a chargeable parking space every day at the same time without paying his parking fee more than once. Such a manipulation can be prevented in accordance with the present invention by providing that the time indicator indicates not only the actual time but also gives an indication of the date.

The feature essential to devices according to the present invention, that the operative position or condition of the device itself cannot be maintained when the time indication is altered, can be mechanically achieved in numerous alternative ways. Therefore, provision should be made either that the means for setting the time indicator is only accessible or operable once the device has first been rendered inoperative, or alternatively that the actuating device for indicating the time may be connected for positive movement with the device for indicating the operative condition, so that any alteration of the time indication produces the inoperative state which may likewise be indicated.

BRIEF DESCRIPTION OF THE DRAWINGS

Embodiments of the invention will be explained in more detail below, with reference to the attached drawings, in which:

FIGS. 4*c* to *f* illustrate component parts of the embodiment of FIGS. 4*a* and 4*b*.

DETAILED DESCRIPTION OF THE INVENTION

Figure 1A:
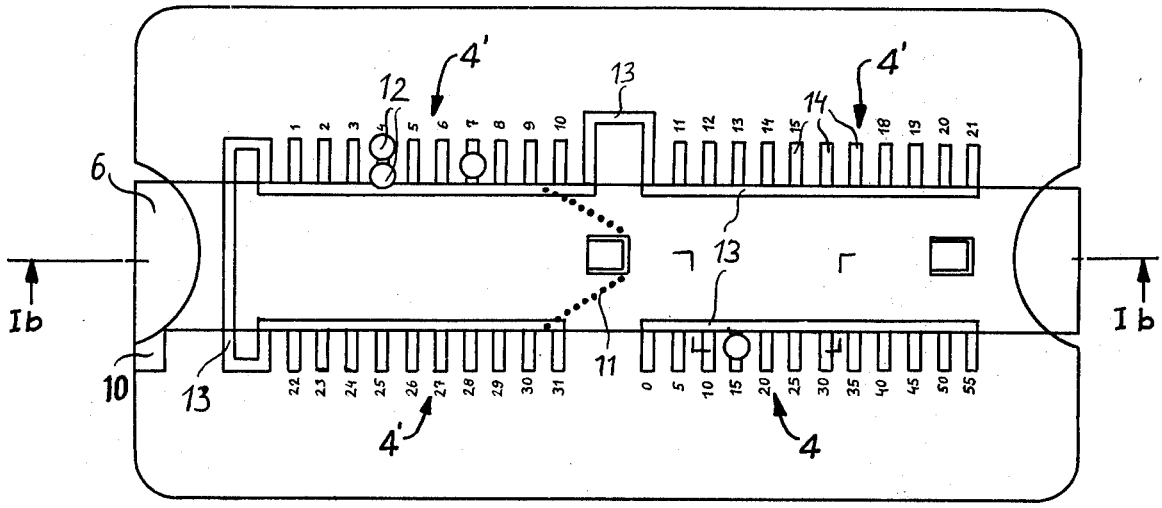
FIG. 1*a* is a plan view of a first embodiment of the invention.

In the first embodiment of the present invention, a cassette is provided which consists of a baseplate 1 and a transparent cover plate 2. The cover plate 2 is provided with continuous grooves in which knobs 12 are displaceably disposed. These grooves are in the form of substantially straight displacement paths 13 from which separate branch grooves 14 extend toward individual markings or indicia 4 and 4'. The knobs 12 are prevented from falling out of the grooves by the provision on each knob of a widened foot portion which is broader than the grooves in the cover plate 2. The size or width of the grooves generally corresponds to the dimension of the portion of the knobs 12 positioned in the grooves. In the region of the foot portion of each of the knobs, the displacement paths 13 and the branch grooves 14 must naturally be sufficiently wide to provide room for the foot portions of the knobs 12. This may be achieved by the provision of appropriate recesses on the underside of the cover plate 2 or on the upper side of the baseplate 1. It is possible, in the embodiment illustrated, to indicate hours, minutes and the month and day by an appropriate disposition of the knobs 12. The same markings or indicia 4' may be used to indicate hours, months and days and the markings or indicia 4 may be used solely to sub-divide the hourly period into minutes.

Figure 1B:
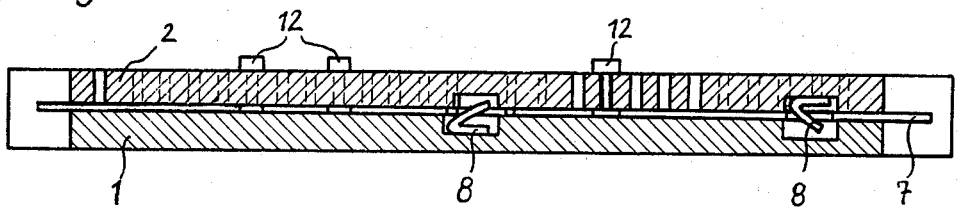
FIG. 1*b* is a vertical section through lines Ib-Ib of FIG. 1*a;*

The indication of the operative state or position is achieved in this embodiment by a value strip 6 which is inserted into a slot 7 from the left thereof as viewed in FIGS. 1*a* and 1*b*. In order to ensure that once the value strip has been completely pushed in the slot 7, it cannot be removed and used again, detents 8 within the cassette engage in recesses 9 in the value strip 6. This makes it impossible to withdraw the value strip without destruction thereof.

The device of this embodiment is positioned in the operative state or condition, after the knobs 12 have been arranged to suitably indicate the time, when an intact value strip 6 has been pushed as far as it will go into the slot 7. Whether this condition is present can easily be established by monitoring supervisor if the device is displayed in the interior of a motor vehicle. In this operative state or condition, the value strip 6 partially fills the displacement paths 13, so that an alteration of the positions of knobs 12 and thus of the time indication is impossible. To alter the positions of knobs 12, it is necessary for the value strip 6 corresponding to one definite monetary value, to be withdrawn from slot 7, such withdrawal destroying the strip. Destruction is effected in that perforations 11 laterally adjacent one of the cut-outs 9 allow the strip to be torn through when the strip is withdrawn in the direction in which it was inserted into slot 7 since the end of strip 6 is held fast by a projection 10. This of course requires that the strip be weaker in the vicinity of the perforations 11 than it is in the region of the projection 10. However, a failure of the perforations to break would be of no great importance, since this would only result in the value strip 6 being destroyed in the vicinity of the projection 10 rather than at perforations 11.

Figure 2A:
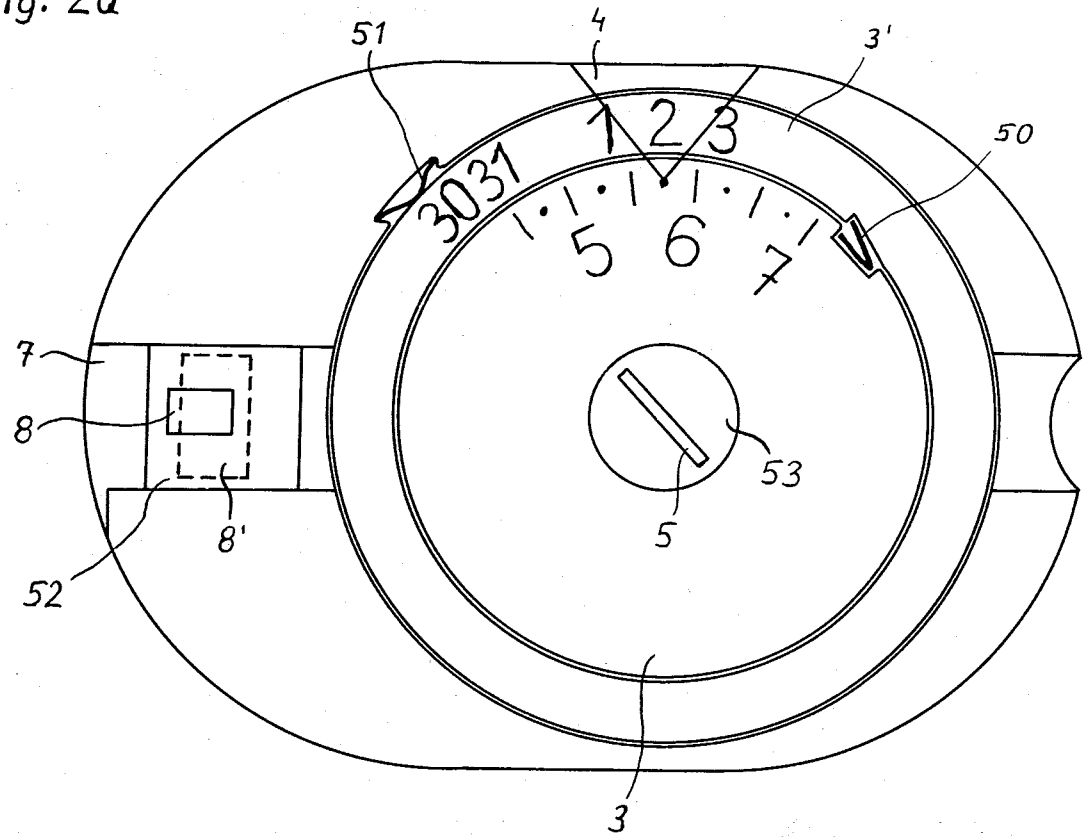
FIG. 2*a* is a plan view of a second embodiment of the invention.
Figure 2C:
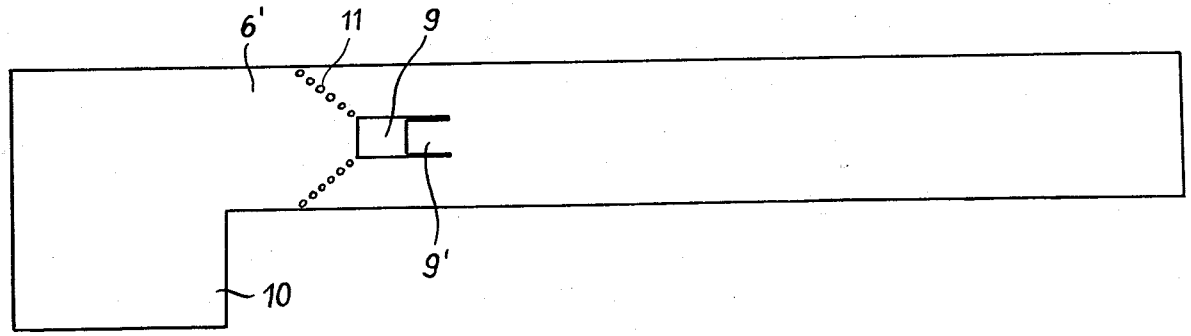
FIG. 2*c* is a plan view of the value symbol of FIG. 2*b*.
Figure 2B:
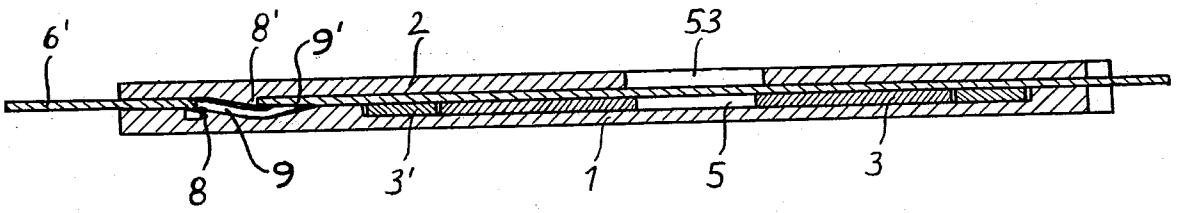
FIG. 2*b* is a vertical section of the device of FIG. 2 but with a value symbol positioned therein.

With reference to FIGS. 2*a*–2*c*, a second embodiment of the invention will be described. A cassette likewise consists of a baseplate 1 and a cover plate 2 which is transparent or which has inspection windows therein. The baseplate 1 is provided on the upper surface thereof with a depression to accommodate two concentric discs 3 and 3′ which can be connected to one another by detent spring 50 so that outer disc 3′ is rotated upon rotation of inner disc 3 in one direction of rotation only. Discs 3 and 3′ have indicia thereon which cooperate with a marking 4 machined into the baseplate 1. By selective rotation of the disc 3, for example by means of a coin introduced into the slot 5, the indicated date and time of day can be adjusted. Firstly, by rotating disc 3, and thus disc 3′, clockwise, the desired date can be selected. Thereafter, the desired time of day may be met by counterclockwise rotation of disc 3, during which the friction spring 51 prevents a simultaneous rotation of the date disc 3′.

Figure 1C:
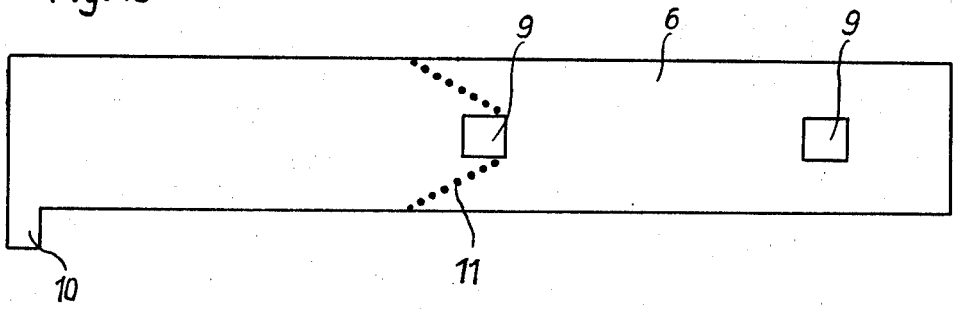
FIG. 1*c* is a plan view of an associated value symbol.

Once the date and time are set, the operating condition of the device is in turn indicated by a value strip 6′. Such a value strip is inserted from the left as viewed in FIGS. 2*a* and 2*b* into the slot 7 which extends above the rotary discs 3 and 3′ transversely through the entire cassette. In order to ensure that, once the value strip 6′ has been pushed completely into slot 7, it cannot be removed and used again, two serrated projections 8 and 8′ are provided in the cassette. The projection 8 protrudes into a cut-out 9 in the value strip 6′, while the projection 8′ is approximately as wide as the value strip 6′. Removal of the value strip 6′ can only be effected by further movement of the strip in the insertion direction. This results in the projection 10 being torn off, in a manner similar to that discussed above with regard to FIGS. 1*a*–1*c*, thus rendering the value strip 6′ valueless. In order to facilitate separation of the projection 10, perforations 11 may be provided.

The value strip 6′, viewed in the direction in which it is inserted, has after the cut-out 9 a lug 9′, the free end of which protrudes into the cut-out 9. This lug, as can be seen in FIG. 2*b*, and in conjunction with the projection 8′ and an obliquely rising depression 52 in the baseplate 1, prevents the value strip 6′ from being withdrawn in an undamaged condition against the direction of insertion, by the insertion of a thin strip over the value strip 6′, and then being used again. When the value strip 6′ is fully inserted into slot 7, the lug 9′ occupies a position which corresponds to the (viewed in the direction of insertion) further extention of the slot 7, while the edge portions of the strip in the region of the lugs 9′ must bend to follow the projection 8′ or the rising portion of the depression 52. If a further strip is now inserted over the value strip 6′ in an attempt to withdraw the strip undamaged and against the direction of insertion, in order that the strip may be used again, then the additional strip must also follow the projection 8′ and the rising portion of the depression 52 and therefore is pushed between the lug 9′ and the marginal zones of the value strip 6′. Therefore, withdrawal of the value strip 6′ against the direction of insertion thereof is prevented in this embodiment.

The apparatus is in its operative position or condition when an intact value strip is inserted as far as it will go into the slot 7. In this condition, the value strip 6′ covers the slot 5 of the disc 3 of the cut-out 53 in the cover plate 2, so that any movement of the time and date discs 3 and 3′ is impossible. In order to be able to adjust either of the discs, it is necessary for the value strip 6′ corresponding to a definite monetary value to be withdrawn and thereby destroyed.

Figure 3A:
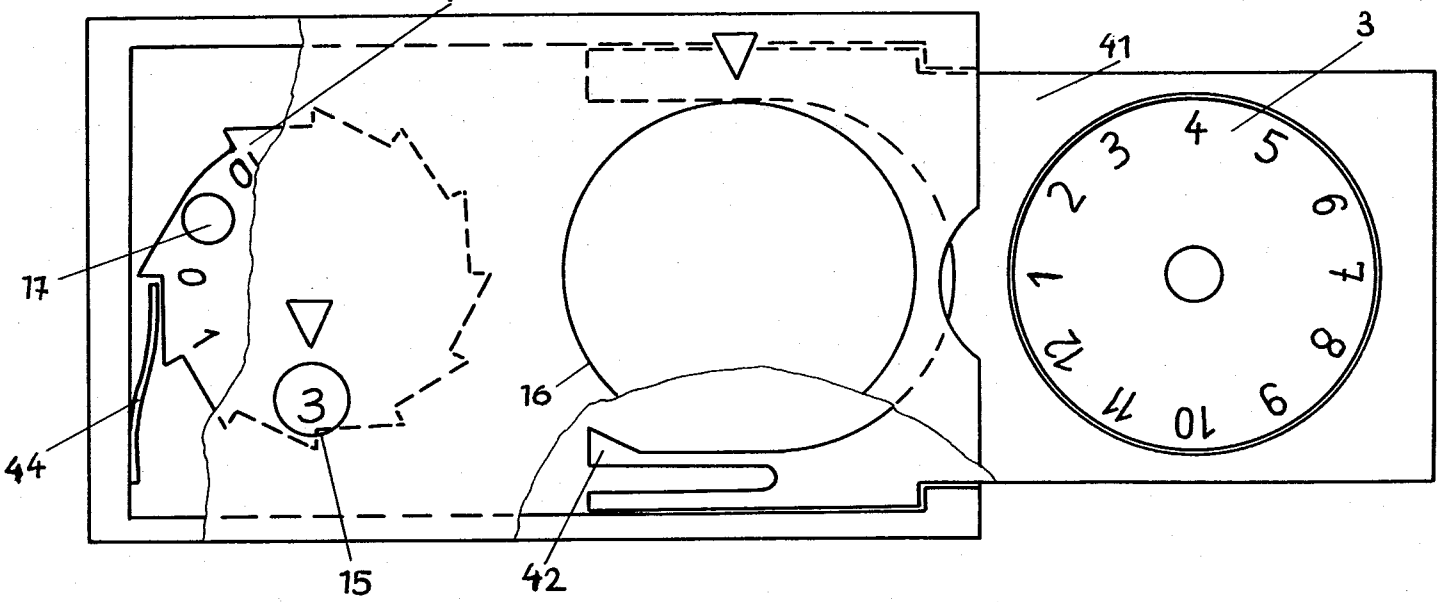
FIGS. 3*a* and 3*b* are respectively a plan view of and vertical section through a third embodiment of the invention.
Figure 3B:
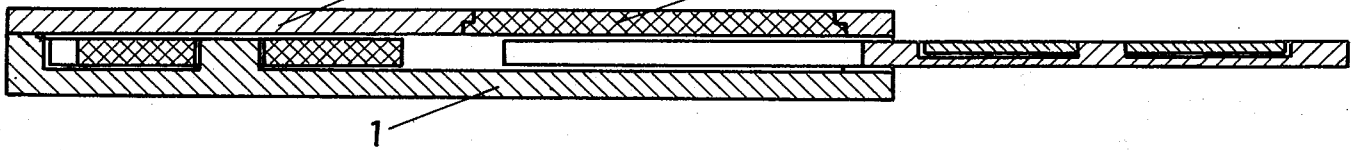
Figure 4A:
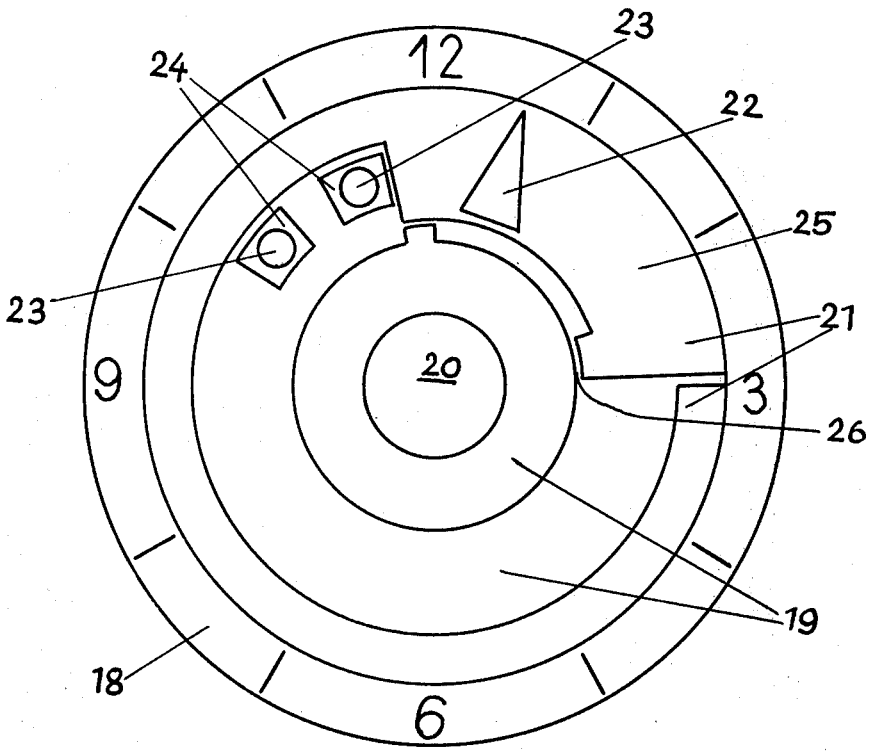
FIG. 4*a* is a plan view of a fourth embodiment of the invention.
Figure 4B:
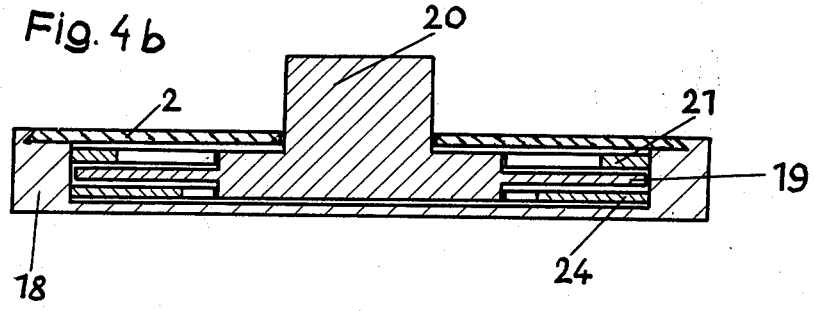
FIG. 4*b* is a vertical section through the device of FIG. 4*a;*
Figure 4E:
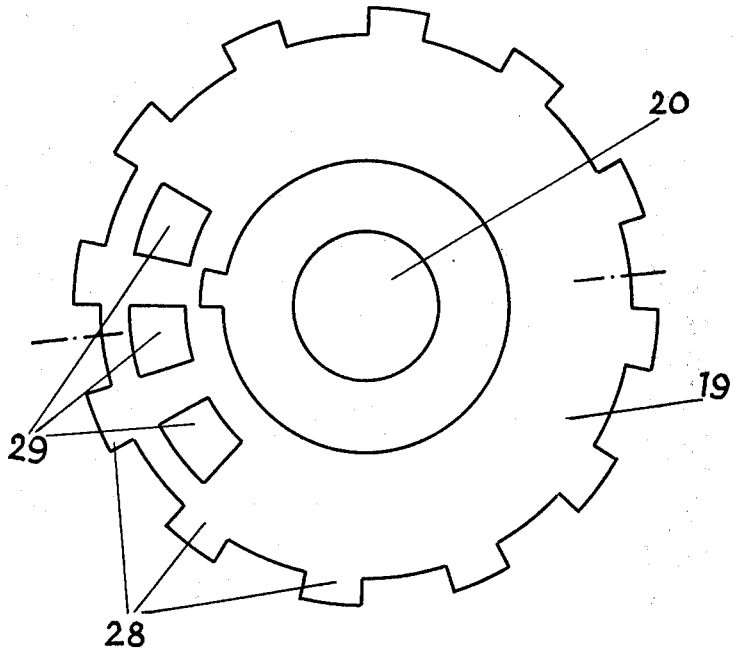
Figure 4F:
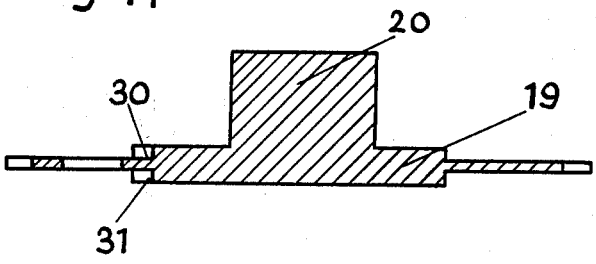

In the embodiment shown in FIGS. 3*a* and 3*b*, the element indicating an operative condition is not destroyed. A rotary disc 3 indicating the time of commencement of parking is disposed on a slide 41 which can be pushed in between the baseplate 1 and the cover plate 2. Since the cover plate entirely masks the slide 41 when it is pushed in, any adjustment of the time indicator disc 3 is possible only in the inoperative position or condition of the parking indicator as shown in FIG. 3. When the slide 41 is pushed into the cassette, and the device is therefore changed to its operative condition, a spring abutment 42 on the slide 41 moves the gearwheel 43 by a given step. Upon withdrawal of the slide 41, the detent 44 prevents reverse rotation of the gearwheel 43. An inspector can, through transparent windows 15 and 16 in the cover plate 2, check both the number of forward movements which have been imparted to the gearwheel and also the time of commencement of parking as set on the rotary disc 3. Therefore, it is readily possible to check both whether the device is in the operative state and whether the paid-for parking time has already elapsed. The rotary disc 3 can be adjusted as frequently as required until the eleventh position 17 on the gearwheel 43, carrying a special marking, appears at the window 15. Since no tooth is provided at the eleventh position 17 on the gearwheel 43, any further rotation of the gearwheel 43 by the spring abutment 42 is not possible. The appearance of the marking 17 in the window 15 indicates therefore that the paid-for value is exhausted and that the cassette must be replaced by a new one.

FIGS. 4*a*–4*f* illustrate a further embodiment wherein three discs are disposed in a housing 18 having a transparent cover plate 2. Of these discs, only the actuating disc 19 is directly connected to the rotary knob 20.

Above the actuating disc 19 is positioned a time disc 21 having a pointer 22 which cooperates with indicia on the outer rim of the housing 18 to indicate the time of commencement of parking. Below the actuating disc 19 is a value indicating disc 24 provided with value indicia 23 to indicate the operating state or condition of the device. Time disc 21 and value indicating disc 24 are constructed as cut-open spring rings having their peripheries bearing on the inner cylindrical wall of the housing 18, to which they are thereby coupled by friction. The value indicating disc 24 located under the actuating disc 19 has a spring 27 engaging in the teeth 28 of the actuating disc 19. The value indicia 23 of the disc 24 are preferably colored and can be seen through the windows 29. When the actuating disc 19 is turned clockwise, all three windows 29 therein move under the masking or shielding area 25 of the disc 21. Upon continuation of the clockwise rotation of disc 19, the upper drive member 30 on the actuating disc 19 moves as far as the abutment 26 on the disc 21 and thus moves time disc 21 to a selected position indicating the time of commencement of parking, which is thus set. During this movement, the spring 27 of the disc 24 is permanently coupled to the actuating disc 19 by one of the teeth 28 thereof and disc 24 is likewise moved to the right. Thereafter, upon counter clockwise rotation of disc 19, discs 21 and 24 are prevented from such rotation due to friction with the wall of the housing. Depending on the degree of counter clockwise rotation of disc 19 from one to three windows 29 of the actuating disc 19 will be visible along with the value indicia 23 on disc 24 therebelow. During such counter clockwise rotation, from one to three teeth of disc 19 slide over spring 27, thereby allowing relative movement between discs 19 and 24.

After one complete revolution of disc 19 with respect to disc 19, all value indicia 23 have been traversed and all windows 29 of disc 19 are positioned over invalidated indicia 33 on the disc 24. At the same time, bottom drive member 31 on the actuating disc 19 contacts an abutment 32 on disc 24, so that relative movement of the actuating disc 19 with respect to the disc 24 is prevented. At such position, all value indicia are used. The last three value indicia 33 may have a different color (for example red) than the other value indicia 23 (yellow), in order to indicate that all of the value indicia have been used. The advantage of this embodiment is that, depending on circumstances, one, two or three value points can be issued at one time.

We claim:

1. A parking indicator comprising:

a casing;

means for indicating the time of commencement of parking, said time indicating means being operably connected to and movable with respect to said casing;

value indicating means insertable into said casing to an operative position whereat said time indicating means is prevented from being further adjusted; and means associated with said casing and said value indicating means for preventing removal of said value indicating means from said operative position within said casing without destruction of said value indicating means.

2. A parking indicator as claimed in claim 1, wherein said time indicating means includes indicia indicative both of the hour and the date of the commencement of parking.

3. A parking indicator as claimed in claim 1, further comprising grooves in said casing, and wherein said time indicating means comprises indicia on said casing adjacent said grooves, and at least one displaceable knob selectively adjustable within said grooves.

4. A parking indicator as claimed in claim 3, wherein said value indicating means comprises a strip positionable in said casing to said operative position, said strip blocking movement of said at least one knob within said grooves when in said operative position.

5. A parking indicator as claimed in claim 1, wherein said casing has a slot therein, said value indicating means comprising a strip positionable in said slot at said operative position.

6. A parking indicator as claimed in claim 5, wherein said removal preventing means comprises at least one recess in said strip and a corresponding at least one detent in said casing, said detent extending into said recess when said strip is in said operative position and preventing non-destructive removal of said strip from said slot.

7. A parking indicator as claimed in claim 6, wherein said strip further has an integral tongue separated from said strip and extending into said recess.

8. A parking indicator as claimed in claim 6, wherein said strip has at one end thereof at least one integral projection wider than said slot.

9. A parking indicator as claimed in claim 8, wherein said strip further has therein perforations forming means for weakening said strip so that said strip will separate at said perforations before tearing of said projection upon an attempted removal of said strip from said slot.

10. A parking indicator as claimed in claim 9, wherein said perforations are positioned laterally of said recess.

11. A parking indicator as claimed in claim 1, wherein said time indicating means comprises at least one disc mounted for rotation within said casing, and indicia on said at least one disc.

12. A parking indicator as claimed in claim 11, wherein said casing has an opening therethrough providing access to said at least one disc so that said at least one disc may be selectively rotated.

13. A parking indicator as claimed in claim 12, wherein said value indicating means comprises a strip positionable in said casing to said operative position, said strip covering said opening when in said operative position.

14. A parking indicator as claimed in claim 11, wherein said indicating means comprises first and second concentric discs mounted within said casing, each of said discs having indicia thereon.

15. A parking indicator as claimed in claim 14, further comprising means for coupling said first and second discs to allow joint rotation thereof in a first direction but to prevent such joint rotation in a second opposite direction.

16. A parking indicator comprising:

a casing;

adjustable means for indicating the time of commencement of parking, said time indicating means being mounted for movement from an inoperative position outside said casing to an operative position within said casing, said casing covering said time indicating means when in said operative position such that adjustment of said time indicating means is prevented; and value indicating means positioned within said casing indicating a predetermined maximum value and responsive to movement of said time indicating means to said operative position for indicating a diminishing of said predetermined maximum value.

17. A parking indicator as claimed in claim 16, wherein said time indicating means comprises a rotatable disc having time indicia thereon.

18. A parking indicator as claimed in claim 17, further comprising a slide mounted for movement into and out of said casing, said disc being mounted on said slide.

19. A parking indicator as claimed in claim 16, wherein said value indicating means comprises a gear wheel mounted within said casing, said gear wheel having value indicia thereon, said gear wheel being mounted for selective rotation in a first direction, and further comprising means for preventing rotation of said gear wheel in a second opposite direction.

20. A parking indicator as claimed in claim 19, further comprising a slide supporting said time indicating means and mounted for movement into and out of said casing, and means on said slide for rotating said gear wheel by a predetermined amount in said first direction upon movement of said slide into said casing.

* * * * *